US006554379B2

(12) United States Patent
Devine

(10) Patent No.: US 6,554,379 B2
(45) Date of Patent: Apr. 29, 2003

(54) SLIDE RAIL ASSEMBLY WITH FRONT RELEASE

(75) Inventor: Jon E. Devine, Keller, TX (US)

(73) Assignee: Central Industrial Supply Company, Inc., Grand Prairie, TX (US)

( * ) Notice: Subject to any disclaimer, the term of this patent is extended or adjusted under 35 U.S.C. 154(b) by 0 days.

(21) Appl. No.: 09/785,708

(22) Filed: Feb. 16, 2001

(65) Prior Publication Data

US 2002/0113533 A1 Aug. 22, 2002

(51) Int. Cl.[7] ..... A47B 88/00

(52) U.S. Cl. ..... 312/333; 312/334.46; 292/86; 292/81

(58) Field of Search ..... 312/334.46, 334.47, 312/334.44, 333; 292/81, 85, 86; 384/21

(56) References Cited

U.S. PATENT DOCUMENTS

| | | | | |
|---|---|---|---|---|
| 3,123,419 A | | 3/1964 | Maxwell | |
| 3,133,768 A | * | 5/1964 | Klakovich | 312/323 X |
| 3,462,203 A | | 8/1969 | Del Vecchio | |
| 4,272,139 A | | 6/1981 | Fler | |
| 4,370,007 A | | 1/1983 | Fler | |
| 4,441,772 A | | 4/1984 | Fielding et al. | |
| 4,469,384 A | | 9/1984 | Fler et al. | |
| 4,549,773 A | | 10/1985 | Papp et al. | |
| 4,560,212 A | | 12/1985 | Papp et al. | |
| 4,679,950 A | | 7/1987 | Delmege et al. | |
| 4,872,734 A | | 10/1989 | Rechberg | |
| 4,993,847 A | | 2/1991 | Hobbs | |
| 5,033,805 A | | 7/1991 | Hobbs | |
| 5,169,238 A | | 12/1992 | Schenk | |
| 5,309,323 A | * | 5/1994 | Gray et al. | 312/334.44 X |
| 5,405,195 A | * | 4/1995 | Hobbs | 312/334.46 |
| 5,722,750 A | | 3/1998 | Chu | |
| 5,730,514 A | | 3/1998 | Hashemi | |
| 5,757,109 A | | 5/1998 | Parvin | |
| 5,871,265 A | | 2/1999 | Stewart et al. | |
| 5,961,193 A | * | 10/1999 | Hobbs | 312/334.46 X |
| 5,988,780 A | | 11/1999 | Rock et al. | |
| 6,126,255 A | * | 10/2000 | Yang | 312/334.46 |
| 6,209,979 B1 | * | 4/2001 | Fall et al. | 312/333 X |
| 6,224,177 B1 | | 5/2001 | Chu | |
| 6,238,031 B1 | * | 5/2001 | Weng | 312/333 |
| 6,244,678 B1 | | 7/2001 | Dopp et al. | |
| 6,340,212 B1 | * | 1/2002 | Beiss et al. | 312/333 X |
| 2002/0057042 A1 | | 5/2002 | Milligan | |

FOREIGN PATENT DOCUMENTS

| | | | | |
|---|---|---|---|---|
| DE | 3347540 | * | 7/1985 | 312/334.46 |
| DE | 4210017 | * | 10/1992 | 312/334.44 |
| DE | 43 07 911 A1 | | 9/1994 | |
| DE | 201 06 081 U1 | | 8/2001 | |
| EP | 0 421 275 A1 | | 4/1991 | |
| JP | 07039430 | * | 2/1995 | 312/334.44 |

OTHER PUBLICATIONS

European Patent Office; International Search Report; for corresponding Application No. PCT/US 02/04580, mailed Jun. 19, 2002.

* cited by examiner

*Primary Examiner*—Lanna Mai
*Assistant Examiner*—Hanh V. Tran
(74) *Attorney, Agent, or Firm*—Mark W. Handley; Chauza & Handley, L.L.P.

(57) ABSTRACT

A slide rail assembly is provided having first and second slide rails, with the second slide rail being telescopically extendible from the first slide rail. A latch is mounted to the slide rail assembly to retain the second slide rail in a forward, extended position, cantilevered from the first slide rail. A rigid release member is slidably mounted to the second slide rail, and extends from a forward portion of the second slide rail to an intermediate portion of the second slide that is disposed substantially adjacent to the latch, such that movement of the release member in a forward, lineal direction releases the latch from securing the second slide rail in the extended position.

24 Claims, 3 Drawing Sheets

SLIDE RAIL ASSEMBLY WITH FRONT RELEASE

TECHNICAL FIELD OF THE INVENTION

The present invention relates in general to the slide r ail assemblies for drawers, cabinets and equipment racks, and in particular to a slide assembly having a latch with a front release.

BACKGROUND OF THE INVENTION

Slide rail assemblies have been provided for use in furniture, cabinets, equipment racks, server system racks, and such, in which drawers, equipment units, work surfaces, and the like are extendable from within the furniture, cabinets, equipment racks and server system racks. The slide rail assemblies typically have at least two telescoping members, which include a forward slide rail and a rearward slide rail. The rearward slide rail is typically mounted to a cabinet, equipment rack, or the like, and the forward slide rail is telescopically extendible into a cantilevered position, disposed forward of the rearward slide rail. The forward slide rails are usually mounted inward of the rearward slide rails, such that the outwardly disposed slide rails are mounted to the cabinets and the inner slide rails are mounted drawers which extend forward of the cabinets. Prior art slide rail assemblies have included both friction slide rail assemblies and bearing slide rail assemblies. The friction slide rail assemblies typically each have at least two telescopically extendible slide rails which include tracks that define mating bearing faces for slidably engaging, such that one of the slide rails is extendable to cantilevered positions with respect to the other of the slide rails. The bearing slide rail assemblies have at least two telescopically extendible slide rails, except unlike the friction slide rails, the bearing slide rails include moveable bearings, such as ball bearings, roller bearings, and the like.

In some applications, the forward slide rails are latched into forwardly disposed positions with respect to the rearward slide rails. Prior art slide rail assembly latches are typically released by users pushing on portions of the slide rail assembly latches at the forward junctions of rearward and the forward slide rails, to release the forward slide rails from being latched in forwardly disposed position. The forward junctions between the mating slide rails often provide pinch points at which the users may be injured when operating such prior art slide rails. When prior art slide rail assemblies are used to support large drawers or large equipment racks in cantilevered, forward positions, it is often difficult for the users to simultaneously reach around opposite sides of the large drawers or equipment racks to simultaneously release the slide rail assembly latches on the opposite sides, making the slide rail assembly installations more difficult to operate and increasing the chances of injury to the users by having fingers or hands caught in the pinch points between the telescopically extendible slide rails.

SUMMARY OF THE INVENTION

A slide rail assembly is provided having first and second slide rails, with the first slide rail being telescopically extendible from the first slide rail. A latch is provided for releasably securing the second slide rail in an extended position, forward of the first slide rail. The latch includes a catch member which is mounted to the first slide rail and a latch member which is mounted to the second slide rail. The catch member and the latch member are mounted such that the latch member is aligned with the catch member when the second slide rail is disposed in the extended position, and the latch member engages the catch member to releasably secure the second slide rail in the extended position. A rigid release member is slidably mounted to the second slide rail for moving in a lineal direction. The rigid release member extends from a forward portion of the second slide rail to an intermediate portion of the second slide that is disposed substantially adjacent to the latch member, such that movement of the release member in a forward direction retracts the latch member from engaging the catch member of the first slide rail. With the latch member retracted from the catch member, the second slide rail may be moved relative to the first slide rail, from the extended position to another position with respect to the first slide rail.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
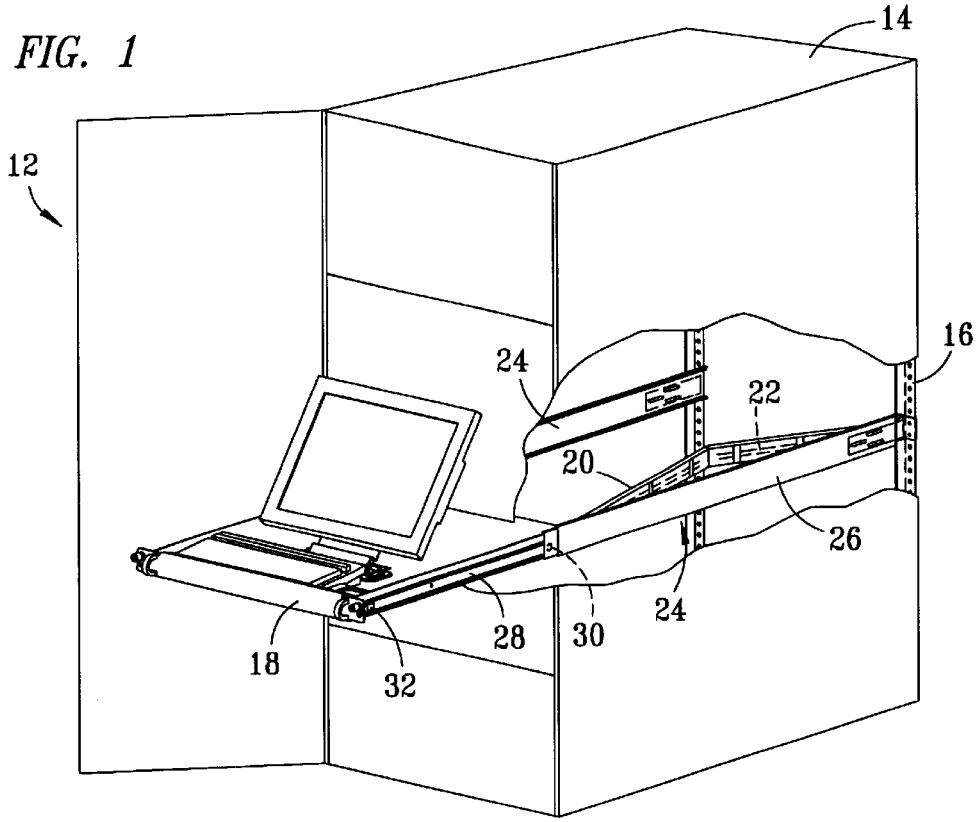
FIG. 1 is a cutaway, perspective view of an equipment cabinet having a drawer which is mounted to the equipment cabinet by two slide rail assemblies having latches with forward releases.

FIG. 1 is a cutaway, perspective view of an equipment rack 12 of a cabinet 14. The equipment rack 12 includes a rack frame 16 to which a drawer 18 is slidably mounted. A cable management arm 20 provides a flexible member which extends between the drawer 18 and the rack frame 16 to secure cabling 22. Opposite sides of the drawer 18 are mounted to the frame 16 by two slide rail assemblies 24. The slide rail assemblies 24 are two-part slide rail assemblies, which each includes a rearwardly disposed slide rail 26 and a forward slide rail 28. The rearward slide rail 26 is fixedly mounted to the frame 16 for mounting the slide rail assembly 24 to the cabinet 14. The forward slide rail 28 is slidably extendible from within the rearward slide rail 26, such that the slide rail 28 is telescopically movable to extend from within the rearward slide rail 26. A latch mechanism 30 is provided for latching the forward slide rail 28 in a forward position with respect to the rearward slide rail 26. The slide rail assemblies 24 each further include a forward release 32, which extends to a position that is distally removed from the latch 30. The forward release 32 is preferably disposed at the forward end of the forward slide rail 28, such that the latch 30 may be released from the forward end of the forward slide rail 28, from a position which is remote from the latch 30.

Figure 2:
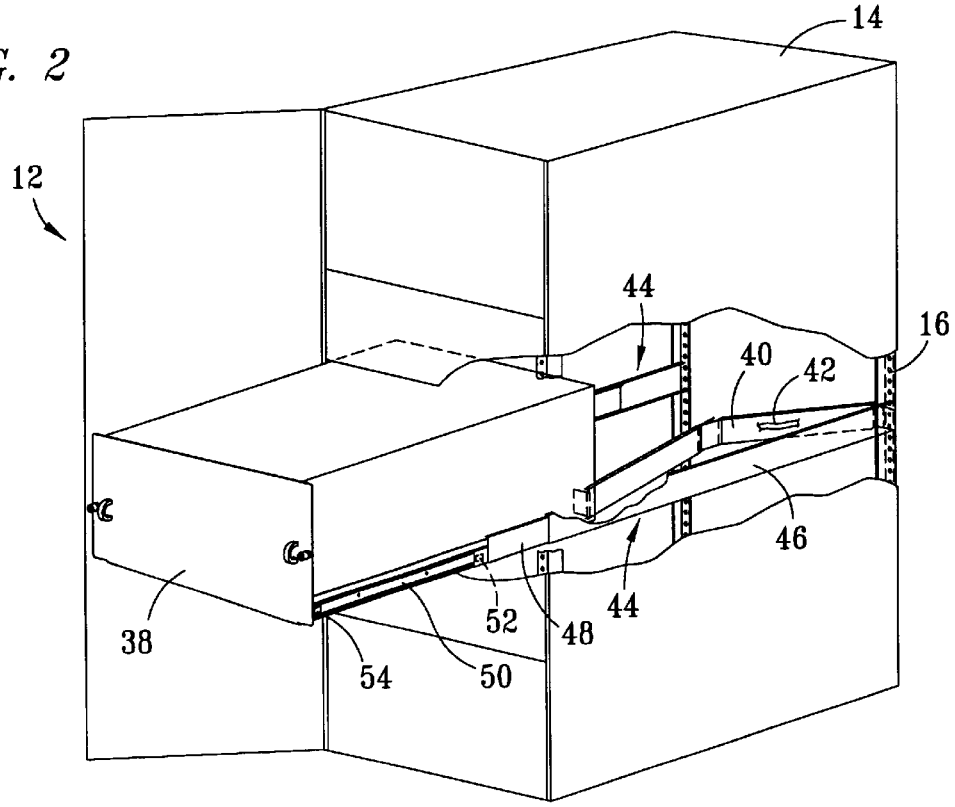
FIG. 2 is a cutaway, perspective view of an equipment cabinet having an equipment unit drawer which is mounted to the cabinet with slide rail assemblies having latches with forward releases.

FIG. 2 is a cutaway, perspective view of the rack 12 of the equipment cabinet 14 having the frame 16. A drawer 38 is shown as an equipment unit which is mounted to the frame 16 by two slide rail assemblies 44, with one of the slide rail assemblies 44 disposed on each side of the drawer 38. A cable management arm 40 extends between the rearward end of the drawer 38 and the rearward end of the cabinet 14 to provide a flexible arm for securing cabling 42 which passes between the cabinet 14 and the drawer 38. The slide rail assemblies 44 are similar in structure to the slide assembly 24 of FIG. 1, except that the slide rail assemblies 44 include three slide rails, which are telescopically extendable.

The slide rail assemblies 44 each include a rearward slide rail 46, which is fixedly mounted to the frame 16 such that it provides a mounting rail for respective ones of the slide rail assemblies 44. Intermediate slide rails 48 are mounted to the rearward slide rails 46, such that the intermediate slide rails 48 are telescopically extendable from the rearward slide rails 46. Forward slide rails 50 are slidably mounted to respective ones of the intermediate slide rails 48, such that the forward slide rails 50 are telescopically extendable from the respective intermediate slide rails 48. Preferably, the intermediate slide rails 48 provide first slide rails, and the forward slide rails 50 provide second rails, which are telescopically extended to forward positions with respect to respective ones of the rearward slide rails 46 and the intermediate slide rails 48. The slide rail assemblies 44 each have a latch mechanism 52 and a forwardly disposed, latch release 54. The forward end of the latch release members 54 are distally disposed from the respective latch mechanisms 52. Preferably, the forward ends of the releases 54 are disposed close to forward ends of the respective forward slide rail 50. The latch mechanisms 52 and the release members 54 are preferably identical to the latches 30 and the forward releases 32 of FIG. 1. As used herein, the intermediate slide rails 48 may be referred to as rearward slide rails in reference to being rearwardly disposed of respective ones of the forward slide rails 50, although such intermediate slide rails 48 may not be the rearward-most slide rails of particular slide rail assemblies. The intermediate slide rails 48 may also be referred to as being secured to the rack frames 16, for the forward slide rails to telescopically extend therefrom in a cantilevered arrangement.

Figure 3:
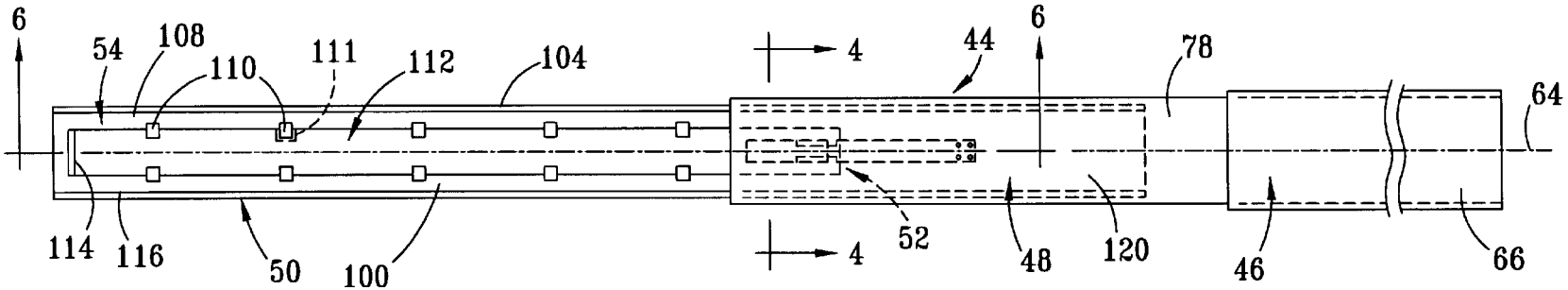
FIG. 3 is a side elevation view of a three part slide rail assembly.
Figure 4:
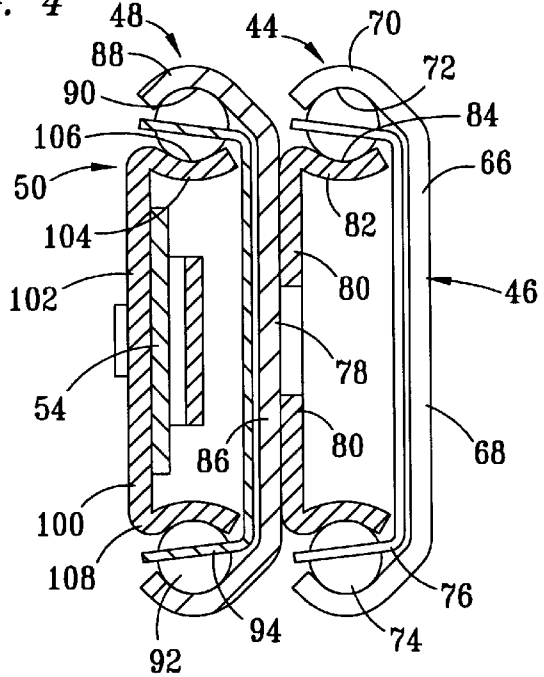
FIG. 4 is a sectional view of the slide rail assembly, taken along section line 4—4 of FIG. 3.

FIG. 3 is a side elevation view of one of the slide rail assemblies 44, and FIG. 4 is a sectional view of the slide rail assembly 44, taken along section line 4—4 of FIG. 3. It should be noted that the various components described for the slide rail assembly 44 may be used for other telescopically extending slide rail assemblies having a different number of slide rails, such as the slide rail assemblies 24 shown in FIG. 1. The slide rail assembly 44 has a longitudinal axis 64, along which the intermediate slide rail 48 and the forward slide rail 50 are telescopically extendable with respect to the rearward slide rail 46. The longitudinal axis 64 also extends in the direction of the lengths, that is in the direction of the longer dimensions, of the elongated bodies of the slide rails 46, 48 and 50. The rearward slide rail 46 has an elongated body 66, which is preferably formed of sheet metal into a channel of a generally U-shaped cross section. The elongated body 66 has a main portion 68, which is of a planar shape, and two edge portions 70 which are preferably arcuately shaped to define faces 72 which provide bearing races for matingly engaging with ball bearings 74. The edge portions 70 define track members of the elongate body 66. The arcuately shaped faces 72 of the edge portions 70 are oppositely disposed to face in inward directions, such that they will matingly engage with the ball bearings 74 which are disposed between the two edge portions 70. A ball bearing retainer 76 secures the ball bearings 74 in respective relative positions, disposed on the elongate body 66.

The slide rail 48 has an elongate body 78, which preferably is formed of sheet metal into a channel of a generally U-shaped cross section. The elongate body 78 has a slide rail interface member 80, which preferably is provided by two track members 82 which have L-shaped cross-sections. In the preferred embodiment, the two track members 82 are mounted to one side of a main body portion 86 of the elongate body 78. The track members 82 have outwardly disposed faces 84 for engaging the ball bearings 74 of the rearward slide rail 46. The main body portion 86 is preferably of a planar shape and has edge regions which extend to define edge portions 88. The edge portions 88 have respective bearing faces 90, which face inward, in opposite directions to provide bearing races for engaging ball bearings 92. The ball bearings 92 are held in place within the slide rail 48 by a ball bearing retainer 94.

The forward slide rail 50 has an elongate body 100 which is preferably formed of sheet metal into a channel of a generally U-shaped cross section. The elongate body 100 has a main body portion 102 which is of a planar shape. Edge regions of the main body portion 102 extend into edge portions 104 having outwardly disposed bearing faces 106. The faces 106 are disposed to face in oppositely, outwardly disposed directions to provide bearing races for engaging the ball bearings 92 of the intermediate slide rail 48. The edge regions of the main body portion 102 have tabs 110 which extend from the sides of the main body portion 102, inward toward opposite sides of the elongate body 100. The tabs 110 are provided by stamping the main body portion 102, such that holes 111 are left in the main body portion 102, adjacent to the tabs 110. The tabs 110 are provided on opposite sides of the main body portion 102, and are spaced apart from the planar surface of the outer side of the main body portion 102 for slidably retaining the forward release 32 on the slide rail 50.

Figure 5:
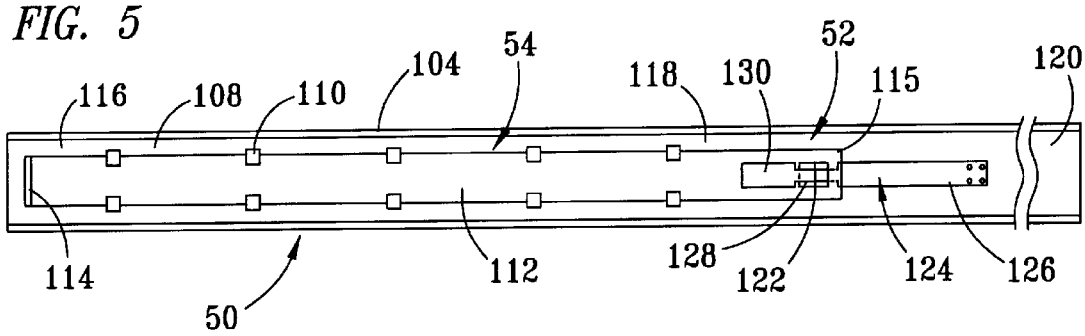
FIG. 5 is a side elevation of a forward slide rail of the slide rail assembly.
Figure 6:
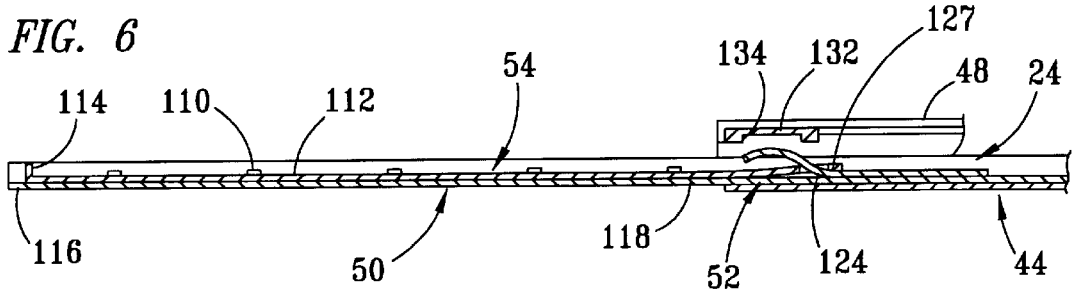
FIG. 6 is a partial section view of the slide rail assembly, taken along section line 6—6 of FIG 3.

FIG. 5 is a side elevation view of the forward slide rail 50, and FIG. 6 is a partial section view of the slide rail assembly 44, taken along section line 6—6 of FIG. 3. The forward release 54 is preferably provided by a rigid strip 112, which is of elongate shape. Preferably, the rigid strip 112 is provided by sheet metal which is formed to have a forward end 114 that is bent upwards ninety degrees to provide a tab for a user to grip the forward end of the rigid strip of metal 112 to pull forward to release the latch mechanism 52. The strip may also be pushed rearward to engage the latch mechanism 52, to latch the forward slide rail 50 in an extended position with respect to the rearwardly disposed, intermediate slide rail 48. The raised forward end 114 of the forward release 54 is disposed at a forward end 116 of the slide rail 50. A rearward terminal end 115 of the forward release 54 is disposed at an intermediate region 118 of the slide rail 50. When disposed in the extended position, the forward slide rail 50 has a rearward region 120 which is disposed at an intermediate portion of the intermediate slide rail 48. (See FIG. 3). The rearward end of the forward release 54 has a rectangular-shaped aperture 122 for engaging a latch member 124. Preferably, the latch member 124 is mounted to the forward slide rail 50 in the intermediate region 118.

A catch member 132 provides a latch member which is shown mounted to the intermediate slide rail member 48, disposed in an oppositely facing arrangement to with the latch member 124 of the forward slide rail 50 when the forward slide rail 50 is disposed in the forward, extended position. The latch member 132 has an aperture 134 for receiving the head 130 of the latch member 124. The latch member 124 is formed of spring steel to have a shape such that when the latch member 124 is aligned adjacent to the catch 132, the head 130 will be urged by a base 126 and a neck-down portion 128 of the latch member 124 to engage within the aperture 134 of the latch member 132, to latch the forward slide rail 50 in the extended position with respect to the intermediate slide rail 48. The head 130 is rotated about the portion 127 of the latch member 124, to move either away from or closer to a flat planar surface 129 of the release arm 172 and the main body portion 102 of the forward slide rail 50. Thus, the latch member 132 provides a first latch member and the latch member 124 provides a second latch member, with the forward release 54 releasably engaging the latch member 124, such that movement of the release 54 in a forward, lineal direction releases the latch member 124 from engaging the catch 132. In other slide rail assemblies, the forward release 54 may provide a release means which is mounted to a forwardly disposed slide rail for engaging a latch means, with the release means extending from a forward portion of the forwardly disposed slide rail to engage the latch means, such as the latch 52. The release means may then engage a latch member which is mounted to either of a forwardly disposed or a rearwardly disposed slide rail, for moving the latch member to disengage the latch means, and such latch member may provide a first latch means which is rotated to engage a second latch means, such as the catch means define by the catch member 132.

Figure 7:
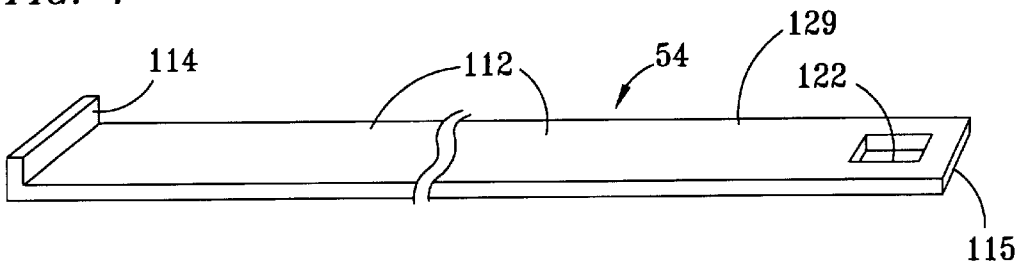
FIG. 7 is a perspective view of a release member of the slide rail assembly.

FIG. 7 is a perspective view of the forward release 54. The forward release 54 is preferably provided by a rigid strip 112, which is of elongate shape. Preferably, the rigid strip 112 is provided by a sheet metal strip which is formed by having the forward end bent upwards ninety degrees to provide a tab 114 for a user to grip the forward end of the rigid strip of metal 112 to pull it forward to release the latch mechanism 52. The aperture 122 is preferably stamped into the strip of sheet metal 112. It should also be noted, that the strip 112 need not be considered rigid when standing alone, separate from the forward slide rail 50, but be formed of a strip having a thickness that when mounted is sliding arrangement with the slide rail 50 is rigid in the sense that one end 114 may be pushed to cause the opposite longitudinal end 115 to move forward.

Figure 8:
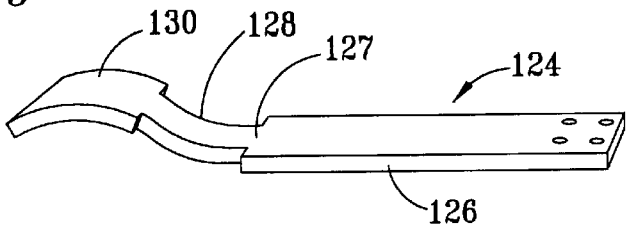
FIG. 8 is a perspective view of a latch member of the latch for the slide rail assembly.

FIG. 8 is a perspective view of a latch member 124 of the latch means 52. The latch member 124 is preferably formed of a strip of spring steel of a uniform thickness. The latch member 124 has a width which varies to define a base portion 126, a necked-down portion 128 and a head 130. The width of the necked-down portion 128 is narrower than the base 126 and the head 130. Preferably, the latch member 124 is riveted in position to fixedly mount the latch member 124 to the elongate body 100 of the forward slide rail 50. The portion 127 is defined to extend between the necked-down portion 128 and the base 126, and defines a region about which the head 130 rotates about to move relative to the planar surface of the main body portion 102 of the forward slide rail 50, such that the head 130 moves toward and away from the main body portion 102 of the forward slide rail and the catch member 132.

Slide rail assemblies made according to the present invention provide advantages over prior art slide rail assemblies. Slide rail assembly latches having forward releases are easier to use than release latches which are operated by a user at interfaces between two mating slide rails, especially when such slide rail assemblies are used to support drawers of larger size. Forward releases allow users to operate release latches at points which are distal from pinch points defined by the interfaces between the two slide rails, preventing injuries to users. It should also be noted that slide rail assemblies and forward release members may be formed of materials other than metal, such as molded plastics.

Although the preferred embodiment has been described in detail, it should be understood that various changes, substitutions and alterations can be made therein without departing from the spirit and scope of the invention as defined by the appended claims.

What is claimed is:

1. A slide rail assembly comprising:

a first slide rail having a first elongated body, wherein said first elongated body has a first latch member and first track members, said first track members being spaced apart to extend in an oppositely facing arrangement along at least part of a longitudinal length of said first elongated body;

a second slide rail having a second elongated body, wherein said second elongated body has a second latch member and second track members, said second track members extending lengthwise along at least part of said second elongated body in a spaced apart, oppositely facing alignment for moveably engaging said first track members of said first elongated body;

wherein said second track members are moveable relative to said first track members to extend said second slide rail forward of said first slide rail and align said second latch member with said first latch member, such that said first and second latch members will releasibly engage to latch said second slide rail a forward position, extended forward of said first slide rail, and fixed in said forward position; and a release member moveably mounted to said second slide rail by at least one retention member which is fixed to said second slide rail, said release member extending from a portion of said second slide rail which is disposed substantially forward of said first slide rail to one of said first and second latch members when said second slide rail is disposed in said forward position, such that said release member is slidably moveable to movably engage said one of said first and second latch members to release said first and second latch members from engaging and release said second slide rail from being fixed in said forward position, extended forward of said first slide rail.

2. The slide rail assembly according to claim 1, wherein said release member moveably engages said second latch member to release said second latch member from engaging said first latch member and release said second slide rail from said forward position, extended forward of said first slide rail.

3. The slide rail assembly according to claim 2, wherein said second latch member comprises a head portion which rotates relative to said second latch member in response to movement of said release member to engage and to release from said first latch member.

4. The slide arm assembly according to claim 1, wherein said at least one retention member of said second slide rail comprises a plurality of tabs which extend from at least one region of said second elongated body, with end portions spaced apart from a main portion of said second elongated body and aside of said release member.

5. The slide arm assembly according to claim 4, wherein said first and second slide rails are formed of metal.

6. The slide rail assembly according to claim 5, further comprising a bearing slide assembly.

7. A slide rail assembly comprising:

a first slide rail having a first elongated body, wherein said first elongated body has first track members which are spaced apart to extend in an oppositely facing arrangement along at least part of a longitudinal length of said first elongated body;

first latch means mounted to said first slide rail;

a second slide rail having a second elongated body, wherein said second elongated body has a forward section, a rearward section and an intermediate section disposed between said forward and rearward sections, and said second elongated body further includes second track members extending lengthwise along at least part of said second elongated body in a spaced apart, oppositely facing alignment for moveably engaging said first track members of said first elongated body;

wherein second slide rail is telescopically extensible relative to said first slide rail from a retracted position to a forward position in which said forward section and at least part of said intermediate section is disposed forward of said first slide rail; and second latch means mounted to said intermediate section of said second slide rail for engaging said first latch means to latch said second slide rail in said forward position, fixed in said forward position;

release means for engaging one of said first and second latch means to release said first and second latch means from engaging to release said second slide rail from being latched in said forward position, wherein said release means is mounted to said second slide rail by at least one retention member which is fixed to said second slide rail, and saidrelease means slidably extends from said forward section of said second slide rail to said intermediate section of said second slide rail.

8. The slide rail assembly according to claim 7, wherein said release means moveably engages said second latch means to release said second latch means from engaging said first latch means and release said second slide rail from said forward position, extended forward of said first slide rail.

9. The slide arm assembly according to claim 8, wherein said second latch means is rotatable relative to said second slide rail in response to movement of said release means, such that said second latch means is engaged with and released from engagement with said first latch means in response to said movement of said release means.

10. The slide rail assembly according to claim 8, wherein said second latch means comprises an elongated body having an intermediately disposed, necked-down portion, and said release means comprises a rearward end portion having an aperture which is sized to receive said intermediately disposed, necked-down portion of said second latch means, such that forward movement of said release means urges said second latch means to move from engaging said first latch means.

11. The slide arm assembly according to claim 10, wherein said at least one retention member of said second slide rail comprises a plurality of tabs which extend from at least one edge region toward at least one opposite edge region, spaced apart from a main portion of said second elongated body and aside of said release means.

12. A slide rail assembly comprising:

a first slide rail having a first elongated body, wherein said first elongated body has first track members being spaced apart to extend in an oppositely facing arrangement along at least part of a longitudinal length of said first elongated body;

a catch member mounted to said first elongate body;

a second slide rail having a second elongated body, wherein said second elongated body has forward section, a rearward section and an intermediate section disposed between said forward and rearward sections, and said second elongated body further including second track members which extend lengthwise along at least part of said second elongated body in a spaced apart, oppositely facing alignment for moveably engaging said first track members of said first elongated body;

a latch member mounted to said second elongate body in said intermediate section of said second elongate body for moving to engage said catch member of said first elongate body;

wherein second slide rail is telescopically extensible relative to said first slide rail along a longitudinal axis of said first and second slide rails, from a retracted position to a fixed, forward position in which said forward section and at least part of said intermediate section is disposed forward of said first slide rail in which said latch member is aligned with said catch member, such that said latch member will releasibly engage said catch member to engage said second slide rail said fixed, forward position;

said second slide rail having a plurality of tabs which extend from edge regions of said second slide rail toward opposite edge regions of said second slide rail, such that said tabs extend transverse to said longitudinal axis of said first and second slide rails, spaced apart from a main portion of said second elongated body and aside of a rigid release member;

said rigid release member formed of a strip of metal, having a length which extends parallel to longitudinal axis of said first and second slide rails, said rigid release member slidably extending between said plurality of tabs and said main portion of said elongated body of said second slide rail, from said forward section to said intermediate section of said second slide rail, such that said rigid release member is disposed in alignment for slidably moving relative to said second slide rail to engage said latch member to move said latch member from engaging said catch member and unlatch said second slide rail for moving from said fixed, forward position relative to said first slide rail.

13. The slide rail assembly according to claim 12, wherein said latch member comprises an elongated body having an intermediately disposed, necked-down portion, and said rigid release member comprises a rearward end portion having an aperture which is sized to receive said intermediately disposed, necked-down portion of said second latch member, such that forward movement of said rigid release member urges said latch member to move from engaging said catch member.

14. The slide rail assembly according to claim 13, wherein said latch member is rotatable relative to said second slide rail in response to movement of said rigid release member to release from engaging said catch member.

15. The slide rail assembly according to claim 14, wherein said latch member is rotated in an angular direction such that at least a portion of said latch member is moved toward said second slide rail, and away from said first slide rail and said catch member.

16. In a slide rail assembly having first and second slide rails, the first slide rail including a first elongated body having a first latch member and first track members, the first track members being spaced apart to extend in an oppositely facing arrangement along at least part of a longitudinal length of the first elongated body, and the second slide rail including a second elongated body having a second latch member and second track members, the second track members extending lengthwise along at least part of the second elongated body in a spaced apart, oppositely facing alignment for moveably engaging the first track members of the first elongated body, such that the second slide rail is moveable relative to the first slide rail to extend forward of the first slide rail and align the second latch member with the first latch member to releasibly engage to the first and second latch members and latch the second slide rail a forward position, extended forward of said first slide rail, and fixed into said forward position, the improvement comprising:

a rigid release member moveably mounted to said second slide rail by retention members disposed on said second slide rail said rigid release member extending from a portion of said second slide rail which is disposed substantially forward of said first slide rail to one of said first and second latch members when said second slide rail is disposed in said forward position, such that said rigid release member is slidably moveable to movably engage said one of said first and second latch members to release said first and second latch members from engaging and release said second slide rail from being fixed in said forward position, extended forward of said first slide rail.

17. The slide rail assembly according to claim 16, wherein said release member moveably engages the second latch member to release the second latch member from engaging the first latch member and release said second slide rail from the forward position, extended forward of the first slide rail.

18. The slide rail assembly according to claim 17, wherein said second latch member is rotatable relative to said second slide rail in response to movement of said rigid release member to release from engaging said first latch member.

19. The slide rail assembly according to claim 17, wherein the second latch member comprises an elongated body having an intermediately disposed, necked-down portion, and said release member comprises a rearward end portion having an aperture which is sized to receive said intermediately disposed, necked-down portion of the second latch member, such that forward movement of said release member urges the second latch member to move from engaging the first latch member.

20. The slide rail assembly according to claim 19, wherein said retention members of the second slide rail comprises a plurality of tabs which extend from at least one edge, region toward at least one opposite edge region, spaced apart from a main portion of the second elongated body and aside of said release member.

21. A slide rail assembly comprising:

a first slide rail having a first elongated body, wherein said first elongated body has first track members which are spaced apart to extend in an oppositely facing arrangement along at least part of a longitudinal length of said first elongated body;

first latch means mounted to said first slide rail;

a second slide rail having a second elongated body, wherein said second elongated body has a forward section, a rearward section and an intermediate section disposed between said forward and rearward sections, and said second elongated body further includes second track members extending lengthwise along at least part of said second elongated body in a spaced apart, oppositely facing alignment for moveably engaging said first track members of said first elongated body;

wherein second slide rail is telescopically extensible relative to said first slide rail from a retracted position to a forward position in which said forward section and at least part of said intermediate section is disposed forward of said first slide rail; and second latch means mounted to said intermediate section of said second slide rail for engaging said first latch means to latch said second slide rail in said forward position;

release means for engaging one of said first and second latch means to release said first and second latch means from engaging to release said second slide rail from being latched in said forward position, wherein said release means is mounted to said second slide rail and extends from said forward section of said second slide rail to said intermediate section of said second slide rail;

wherein said release means moveably engages said second latch means to release said second latch means from engaging said first latch means and release said second slide rail from said forward position, extended forward of said first slide rail; and wherein said second latch means comprises an elongated body having an intermediately disposed, necked-down portion, and said release means comprises a rearward end portion having an aperture which is sized to receive said intermediately disposed, necked-down portion of said second latch means, such that forward movement of said release means urges said second latch means to move from engaging said first latch means.

22. The slide rail assembly according to claim 21, wherein said second slide rail comprises a plurality of tabs which extend from at least one edge region toward at least one opposite edge region, spaced apart from a main portion of said second elongated body and aside of said release means, such that said release means is moveably retained on said forwardly extensible one of said first and second slide rails.

23. In a slide rail assembly having first and second slide rails, the first slide rail including a first elongated body having a first latch member and first track members, the first track members being spaced apart to extend in an oppositely facing arrangement along at least part of a longitudinal length of the first elongated body, and the second slide rail including a second elongated body having a second latch member and second track members, the second track members extending lengthwise along at least part of the second elongated body in a spaced apart, oppositely facing alignment for moveably engaging the first track members of the first elongated body, such that the second slide rail is moveable relative to the first slide rail to extend forward of the first slide rail and align the second latch member with the first latch member to releasibly engage to the first and second latch members and latch the second slide rail a forward position, extended forward of said first slide rail, the improvement comprising:

a rigid release member moveably mounted to said second slide rail, said rigid release member extending from a portion of said second slide rail which is disposed substantially forward of said first slide rail to one of said first and second latch members when said second slide rail is disposed in said forward position, such that said rigid release member is moveable to movably engage said one of said first and second latch members to release said first and second latch members from engaging and release said second slide rail from said forward position, extended forward of said first slide rail;

wherein said release member moveably engages the second latch member to release the second latch member from engaging the first latch member and release said second slide rail from the forward position, extended forward of the first slide rail; and wherein the second latch member comprises an elongated body having an intermediately disposed, necked-down portion, and said release member comprises a rearward end portion having an aperture which is sized to receive said intermediately disposed, necked-down portion of the second latch member, such that forward movement of said release member urges the second latch member to move from engaging the first latch member.

24. The slide rail assembly according to claim 23, wherein the second slide rail comprises a plurality of tabs which extend from at least one edge region toward at least one opposite edge region, spaced apart from a main portion of the second elongated body and aside of said release member, such that said release member is moveably retained on the second slide rail.

* * * * *